United States Patent [19]

Hasegawa

[11] 3,986,712

[45] Oct. 19, 1976

[54] FEEDING DEVICE FOR CARD COUNTING MACHINES

[76] Inventor: Kaiichi Hasegawa, 1338 Nakanoshima, Tama, Kawasaki, Japan

[22] Filed: Jan. 2, 1975

[21] Appl. No.: 538,054

[52] U.S. Cl. ..... 271/124; 271/167

[51] Int. Cl.[2] ..... B65H 1/06; B65H 3/46

[58] Field of Search ..... 271/35, 121, 124, 138, 271/165, 167

[56] References Cited

UNITED STATES PATENTS

| | | | |
|---|---|---|---|
| 2,614,837 | 10/1952 | Cuthbert, Jr. | 271/121 |
| 2,705,636 | 4/1955 | Bombard | 271/124 |
| 3,108,799 | 10/1963 | Clemens et al. | 271/35 |
| 3,563,537 | 2/1971 | Thut | 271/124 |

*Primary Examiner*—Robert W. Saifer

*Attorney, Agent, or Firm*—William Anthony Drucker

[57] ABSTRACT

A feeding device for card counting machines has a guide wall member fixed at a distance apart from a feed drum for forwarding sheets of card frictionally and tangentially. In operation, double sheets feeding can decisively be prevented.

3 Claims, 2 Drawing Figures

FEEDING DEVICE FOR CARD COUNTING MACHINES

The present invention relates to devices for feeding sheet by sheet cards, bank notes, bills, or slips of fixed sizes from a pile thereof to a counting device.

It is an object of this invention to provide means for feeding cards or the like sheet by sheet smoothly and without interruption from a pile thereof.

It is another and an important object of this invention to provide means for preventing double sheets feeding which may cause miscount in a counting system.

It is still another object of this invention to provide structures for forwarding cards or the like which structures are hard to be worn.

It is a further object of this invention to provide feeding means for cards or the like which will produce little noise and dust.

Figure 1:
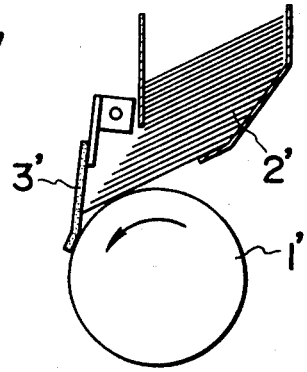
FIG. 1 PRIOR ART

Other objects and merits will become apparent from the following description taken in connection with the accompanying drawings in which:

FIG. 1 is a schematic diagram of a conventional feeding device for card counting machines.

Figure 2:
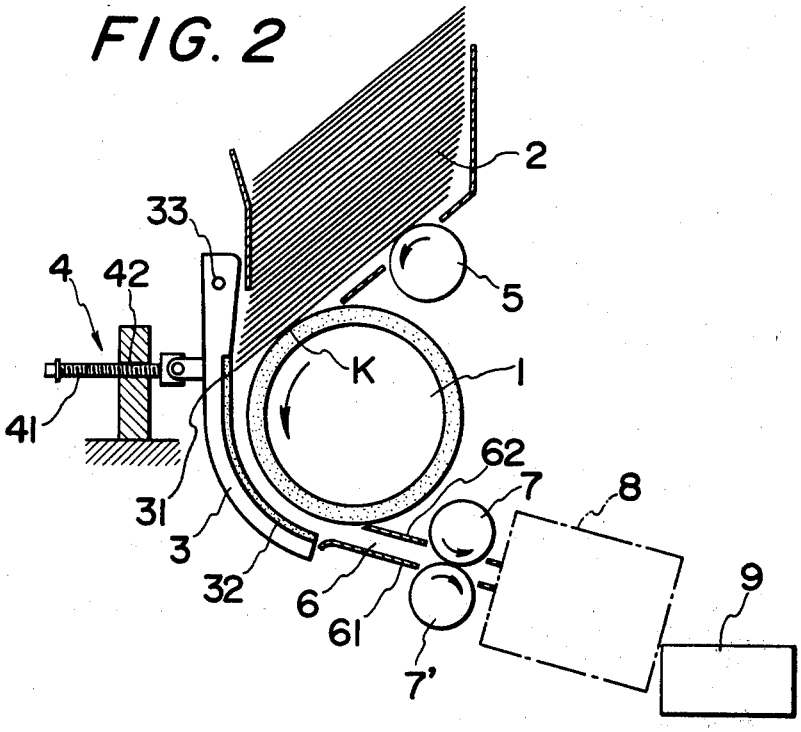

And, FIG. 2 is a schematic diagram of an embodiment of this invention incorporated in a card counting machine.

In FIG. 1, is shown a feeding device of a conventional type for card counting machines. The feeding device is composed of a feed drum 1′ and a guide wall means 3′ of rubber which is forced resiliently by an appropriate spring means to the cylindrical face of said feed drum 1′ so that a point of contact may be formed between said wall means 3′ and said feed drum 1′. Cards 2 are forwarded frictionally by means of said feed drum 1′ through said point of contact. Accordingly, in a period in operation and prior to a first sheet of card passing through said point of contact and in other periods after a sheet has passed through said point of contact and prior to arrival of succeeding sheet to said point of contact, the face of said guide wall means 3′ will rub directly against the face of said feed drum 1′. Also, the face of said guide wall means 3′ will rub against cards passing therealong incessantly throughout operation. Such rubbing action causes, without fail, quick wear of said guide wall means 3′ before it is renewed. In fact, said guide wall means of rubber material are considered as consumption goods. In operation, noise caused by such rubbing action is considerably large and dust of rubber produced by wear of said rubber material scatters around the device. Moreover, on account of uneven wear of the face of said rubber material, double sheet feeding which often results in miscounting occur.

However, according to this invention, defects such as stated in the foregoing in conventional feeding devices can well be eliminated. Hereunder will be stated more fully features and actions of this invention by reference to an embodiment shown in FIG. 2.

In the figure, a guide wall member which is provided for guiding cards sheet by sheet therealong is indicated at 3. Said guide wall member 3 has a portion 31 for engaging ends of cards in pile. Said portion 31 receives and engages the front ends of a substantial amount of the cards in pile 2 upon said cards being put on the guide roller 5 as shown. Said substantial amount of cards includes an end sheet which is the lowermost sheet in the figure. Said cards are to engage said portion 31 of said guide wall member 3 at an acute angle seen from the side opposite to the direction of the transfer of said cards along said guide wall member 3. Such cards are to be forwarded frictionally sheet by sheet by a feed drum 1 in a tangential direction to said feed drum 1. Said guide wall member 3 is positioned at a distance apart from feed drum 1 so that, upon said cards in pile 2 being put on said guide roller 5 as shown and prior to operation of feed drum 1, said lowermost sheet will engage feed drum 1 at a point K which is positioned at a substantial distance apart from the front end of said lowermost sheet which is engaging guide wall member 3. Said guide wall member 3 has also a guidance portion 32 which extends from said portion 31 and substantially along the cylindrical face of said feed drum 1.

Said acute angle at which said cards engage said guide wall member 3 is optimized when it is within a range of 55° to 85° for each kind of card or the like which may be applied to counting machines.

In an embodiment as shown in the figure, numeral 33 indicates a pivot for said guide wall member 3 provided at the upper portion thereof. An adjusting means is indicated at 4. By means of such adjusting means, the distance between said guide wall member 3 and said feed drum 1 can be adjusted appropriately in accordance with size and hardness of cards to be fed. Adjusting means 4 has a positive screw rod 41 screwed adjustably in a negative screw 42. Numeral 5 indicates a guide roller which is to support the rear end portions of the cards in pile 2 at a position rearward of feed drum 1. Said guide roller 5 is provided in a fixed relationship with feed drum 1 so as to constitute a directing means for said cards in pile 2. And, said guide roller 5, in association with feed roller 1 will direct said cards to engage a portion 31 of guide wall member 3 which portion 31 will engage the front ends of said cards in pile 2 at the foregoing acute angle. Numeral 6 indicates a passage for the cards which have been discharged from a feeding device according to this invention. Wall members for said passage 6 are indicated at 61 and 62. Numerals 7 and 7′ indicate feed rollers for counting device 8 which is provided with photoelectric detecting means for detecting cards passing therethrough. And, numeral 9 indicates a basket for receiving cards issued from said counting device 8.

In an embodiment as shown, sheets of card in pile are located above feed drum 1. However, in another embodiment not shown in the drawings, the sheets of card in pile may be located below the feed drum. In such an embodiment, the pile of sheets of card is supported from below and forced upwardly with an appropriate resilient spring means.

For preparing a feeding device in accordance with this invention to operate, the distance between guidance portion 32 and the cylindrical face of feeding drum 1 is adjusted appropriately according to hardness and size of cards to be counted by means of adjusting means 4. Upon operation of feed drum 1, a sheet of card 2 engaging the cylindrical face of said feed drum is forwarded frictionally by said cylindrical face of said feed drum and the front end of said sheet of card engaging said portion 31 of guide wall member 3 at an acute angle moves along guidance portion 32. Then, said sheet of card proceeds to pass the clearance between said guidance portion 32 and the cylindrical face of feed drum 1 and issues from said clearance. During the operation and at a moment in which the rear end of said sheet of card has passed the point K which is a point at which said sheet of card engages the feed drum 1 frictionally the succeeding sheet of card begins to be forwarded into said clearance between said guide wall member 3 and said feed drum 1. Thus, the sheets of card 2 will issue one after another to be fed through between feed rollers 7 and 7' to counting device 8 to be counted thereby and received by basket 9.

As noted in the foregoing, heretofore, guide wall means as indicated at 3' of rubber material was composed to force resiliently to feed drum 1' so as to form a point of contact between said guide wall means 3' and said feed drum 1' in a feeding device for card counting machine. Such a composition of feeding means is based on a reason that a sheet of card is separated from the succeeding sheet upon the front end of the preceeding sheet changing its direction to a direction tangential to said feed drum 1' cylindrical face at said point of contact and being introduced between said guide wall means and said feed drum at said point of contact.

However, as noted in the foregoing, defects of such a conventional structure are apparent. And, separation of cards one sheet from another become delinquent after some time of use.

It has been found in my research and study the facts as follows: The amount of frictional force between guide wall means 3' of rubber material and an end of a sheet of card located at the bottom of a pile of cards and which is going to be fed to said point of contact between said guide wall means 3' and said cylindrical face of said feed drum 1' is substantially equal to the amount of frictional force between said guide wall means 3' and an end of a sheet of card located on and adjacent to said bottom sheet. Accordingly, action of feeding cards is caused by the frictional force between said bottom sheet's bottom face and the face of said feed drum which frictional force overcomes the frictional force between the bottom sheet's upper face and the sheet located on and adjacent to said bottom sheet, and which former frictional force also overcomes the frictional force between the front end of said bottom sheet and said guide wall means 3'. The foregoing point of contact between said guide wall means 3' and said feed drum 1' has no power of separating sheets one from another.

However the separation of sheets can be effected by means of the foregoing conventional feed means, on account of the fact that said guide wall means 3' is resilient and is not in a fixed relationship with the position of feed drum 1', the position of said point of contact together with the angle of contact between said front ends of the cards and said guide wall means 3' changes delicately in operation. Such changes of position of said point of contact and said angle of contact in operation cause change in balance of said frictional forces. And, on account of said guide wall means 3' engaging said feed drum 1', a delicate but an appreciable vibration is caused at said point of contact, particularly in cases in which wear of said point of contact is large. And, caused by said vibration, moments in which a balance between the foregoing frictional forces breaks appear in the course of operation. Such breaking of said frictional forces results in difficulty in the separation of sheets and double sheets feeding.

According to this invention, because that the front ends of a substantial amount of said cards in pile 2 are received at an acute angle by said guide wall member 3, and that said point of contact K is positioned at a substantial distance apart from said front end of said end sheet of said cards in pile 2, a substantial length of the front portion of said end sheet is kept free from other sheets adjacent to said end sheet during operation. This causes easy separation of said end sheet from the adjacent sheet upon said end sheet being forced to be driven by said feed drum 1. Because that said guide wall member 3 is fixed immobile, the angle of contact between the ends of sheets of card and said position 31 is unchanged even in operation. This unchanged angle of contact secures invariable relationship between said frictional forces which leads an appreciable factor for correct separation of cards so as to prevent double sheet feeding.

And, because no contact is provided between said guide wall member 3 and said feed drum 1, there is no vibration in said guide wall member generated by rotation of said feed drum which may cause breaking of said balance of said frictional forces and difficulty in the separation of cards. Accordingly, according to this invention, miscounting caused by double sheets feeding can decisively be eliminated. And, other but appreciable merits that no noise in operation caused by rubbing of the guide wall member against the feed drum, and no dust of resilient material produced by wear of said resilient member on said guide wall member and said feed drum together with smooth feeding action can be attained.

Having thus described my invention what is claimed for Letters Patent is:

1. A feeding device for card counting machines which comprises directing means having means for engaging an end sheet of cards in pile so as to orient said cards in pile, a feed drum having a cylindrical face for engaging said end sheet of cards in pile for frictionally driving said cards, sheet by sheet, out of said cards in pile, and a guide wall member for guiding said cards driven by said feed drum, said directing means having a position rearward of said feed drum in a fixed relationship with said feed drum so that said directing means in association with said feed drum will orient said cards so as to engage a portion of said guide wall member at their front ends at an acute angle seen from the side opposite to the direction of transfer of said cards along said guide wall member, said guide wall member being positioned at a distance apart from said feed drum in affixed relationship therewith so that said end sheet of said cards in pile, upon said cards in pile engaging said directing means and prior to operation of said feed drum, will engage said feed drum at a point which is positioned at a substantial distance apart from the front end of said end sheet which engages said guide wall member, said guide wall member being formed so as to receive and engage the front ends of a substantial amount of said cards in pile including an end sheet of said cards in pile, and said guide wall member having a guidance portion extending from said portion of said guide wall member which portion is substantially flat and is straight in the direction of transfer of said front ends of said sheets, and which portion is to engage said front ends of said cards in pile upon said cards in pile engaging said directing means and prior to operation of said feed drum, and along the cylindrical face of said feed drum.

2. A feeding device for card counting machines as claimed in claim 1, in which said acute angle of engagement is within a range of from 55° to 85°.

3. A feeding device for card counting machines as claimed in claim 1, in which said guide wall member is associated with means for adjusting said distance between said guidance portion and said feed drum.

* * * * *